US005412968A

United States Patent [19]

Benz

[11] Patent Number: 5,412,968

[45] Date of Patent: May 9, 1995

[54] METHOD FOR LEVELING SHEET METAL

[75] Inventor: Willi Benz, Neuss, Germany

[73] Assignee: SMS Schloemann-Siemag Aktiengesellschaft, Duesseldorf, Germany

[21] Appl. No.: 237,430

[22] Filed: May 3, 1994

Related U.S. Application Data

[63] Continuation of Ser. No. 4,398, Jan. 14, 1993, abandoned.

[30] Foreign Application Priority Data

Jan. 16, 1992 [DE] Germany ..... 42 00 922.7

[51] Int. Cl.[6] ..... B21D 1/02

[52] U.S. Cl. ..... 72/164

[58] Field of Search ..... 72/164, 165, 160

[56] References Cited

U.S. PATENT DOCUMENTS

| | | | |
|---|---|---|---|
| 2,592,948 | 4/1952 | Peterson | 72/164 |
| 2,720,243 | 10/1955 | Siegerist | 72/164 |
| 2,852,065 | 9/1958 | Peterson | 72/164 |
| 3,765,210 | 10/1973 | Lemper | 72/164 |
| 3,916,662 | 11/1975 | Arnold | 72/164 |

FOREIGN PATENT DOCUMENTS

| | | | |
|---|---|---|---|
| 3308616 | 9/1984 | Germany | 72/164 |
| 96325 | 5/1985 | Japan | 72/164 |
| 245917 | 11/1986 | Japan | 72/160 |
| 203616 | 9/1987 | Japan | 72/164 |

*Primary Examiner*—Daniel C. Crane

*Attorney, Agent, or Firm*—Anderson Kill Olick & Oshinsky

[57] ABSTRACT

A method and apparatus for leveling of metal sheets conveyed through leveling gaps formed by several adjustable upper and lower leveling rollers and adjusted as a function of the sheet cross-section and the nominal sheet strength is disclosed. After initial maximum deformation, the sheets are subsequently repeatedly bent in alternate directions with a greatly diminishing degree of deformation resulting in an improved operational mode if the leveling range of a leveling machine is expanded toward the thicker metal sheets by a smaller quantity of leveling rollers in engagement, and thus a larger roller pitch, in case of sheet thicknesses exceeding the nominal sheet thickness of the leveling range.

10 Claims, 3 Drawing Sheets

| | | | | |
|---|---|---|---|---|
| xxx | 6 | 4 | 1,55 |
| | 7 | 5 | 1,16 |
| | 7 | 5 | 1,16 |
| xxx | 8 | 4 | 1,55 |
| | 8 | 6 | 1,16 |
| xxx | 9 | 5 | 1,55 |
| xx | 9 | 5 | 1,23 |
| | 9 | 5 | 1,16 |
| xx | 10 | 6 | 1,23 |
| | 10 | 6 | 1,16 |
| xxx | 11 | 5 | 1,55 |
| | 11 | 7 | 1,16 |
| | 11 | 7 | 1,16 |
| xxx | 12 | 6 | 1,55 |
| | 12 | 8 | 1,16 |
| xx | 13 | 7 | 1,23 |
| | 13 | 7 | 1,16 |
| xxx | 14 | 6 | 1,55 |
| xx | 14 | 8 | 1,23 |
| | 14 | 8 | 1,16 |
| xxx | 15 | 7 | 1,55 |
| | 15 | 9 | 1,16 |
| | 15 | 9 | 1,16 |
| | 15 | 7 | 1,16 |

| | | | | |
|---|---|---|---|---|
| 1 | xxx | 6 | 4 | 1,55 |
| 2 | | 7 | 5 | 1,16 |
| 3 | | 7 | 5 | 1,16 |
| 4 | xxx | 8 | 4 | 1,55 |
| 5 | | 8 | 6 | 1,16 |
| 6 | xxx | 9 | 5 | 1,55 |
| 7 | xx | 9 | 5 | 1,23 |
| 8 | | 9 | 5 | 1,16 |
| 9 | xx | 10 | 6 | 1,23 |
| 10 | | 10 | 6 | 1,16 |
| 11 | xxx | 11 | 5 | 1,55 |
| 12 | | 11 | 7 | 1,16 |
| 13 | | 11 | 7 | 1,16 |
| 14 | xxx | 12 | 6 | 1,55 |
| 15 | | 12 | 8 | 1,16 |
| 16 | xx | 13 | 7 | 1,23 |
| 17 | | 13 | 7 | 1,16 |
| 18 | xxx | 14 | 6 | 1,55 |
| 19 | xx | 14 | 8 | 1,23 |
| 20 | | 14 | 8 | 1,16 |
| 21 | xxx | 15 | 7 | 1,55 |
| 22 | | 15 | 9 | 1,16 |
| 23 | | 15 | 9 | 1,16 |
| 24 | | 15 | 7 | 1,16 |

METHOD FOR LEVELING SHEET METAL

This is a continuation application of Ser. No. 08/004,398, filed Jan. 14, 1993, now abandoned.

FIELD OF THE INVENTION

The present invention is directed generally to levelling apparatuses and more particularly to a method for leveling sheet metal.

BACKGROUND OF THE INVENTION

German Offenlegunschrift 3,308,616 discloses a method in which uniformly planar metal sheets are produced with a small number of deformations steps. In this method, the leveling roller adjustments in a leveling machine, comprising several top and bottom, individually adjustable leveling rollers, are continuously corrected in the course of the leveling process, depending upon the sheet metal strength determined from the sheet cross-section and the leveling force. In this method, the changes in strength and cross-section, as well as the resulting difference in stretch or strain of the leveling machine occurring across the length of the sheet, are taken into account when adjusting the leveling gaps or grooves. The thickness of the sheet, the material yield strength and the width of the sheet govern the layout of levelers for sheet metal and strip. The diameter of the leveling roller and the pitch are determined, either from the maximum leveling force or from the maximum torque to be transmitted. Once the leveling roller pitch is determined, taking into account the required maximum deformation (over-stretch) of the metal sheet, the minimum sheet thickness to be leveled is already preset and the thickness range to be leveled is established. For leveling very wide, thick sheets, large drive spindles must be selected because of the large roller diameters for achieving the required torsional stiffness and a larger pitch than with narrower, thinner metal sheets. This, however, greatly limits the capability for leveling thin metal sheets. A thick metal sheet must be bent, to a lesser extent than a thin sheet, in order to achieve equal plastic deformations, because the thin sheet acts like a spring when slightly bent.

German Offenlegunschrift 3,731,234 discloses the reduction of the quantity of rollers in a metal sheet leveler by deforming the sheet metal spasmodically to a lesser extent after maximum bending by intensive deformation rollers and subsequent leveling rollers. In the known leveller, the top and bottom leveling rollers are therefore individually adjustable in the vertical direction.

In view of these drawbacks, it is an object of the invention to create a method and an apparatus enabling an improved operational functioning of a roller leveler.

SUMMARY OF THE INVENTION

These and other objects of the invention, which shall become hereafter apparent, are achieved by a method and apparatus of levelling sheet metal in which the sheet metal is conveyed through several leveling gaps or grooves adjusted according to the cross-section and the nominal strength of the sheet metal and are formed by several adjustable top and bottom leveling rollers.

The objects of the invention are achieved in that, with sheet thicknesses exceeding the nominal sheet thickness of the leveling range and a lower quantity of the leveling rollers in interengagement having a larger roller pitch, the leveling range of a leveller is increased toward the thicker metal sheets.

The invention is also based upon various findings, including that the shaping of the residual stress condition, as well as of the corresponding internal moment course, exerts the most important influence upon the leveling quality. Thus, the nature of the roller adjustment is very significant. Profiled or shaped roller levelers, for instance, are equipped with relatively few (approximately 7 to 9) leveling rollers in view of the individual adjustability of the bottom rollers. The first one is adjusted or screwed-down substantially, and the following ones, to a much lesser degree. The leveling quality to be achieved is quite good. If, however, a tilting yoke adjustment (the leveling rolls move away from each other in a wedge-shaped manner from the inlet toward the outlet), known from sheet metal levelers is simulated in a profile roller leveler, the leveling quality is entirely inadequate and the leveling process is unstable. An extremely large quantity of rollers is required so that an acceptable leveling quality is achieved by a sheet metal leveler with a tilting yoke adjustment. This however makes it impossible to provide an economical leveling machine.

The present invention performs adjustments by using the inlet and outlet portion, with only a short transitional part from a leveling machine system with tilting yoke adjustment. The leveling of sheet metal can thereby be performed using only a few leveling rollers with the lowest expenditure of deformation energy and force, wherein the following overstretch is to be selected at the individual rollers. The rolling material or the entering metal sheet is greatly plasticized in the inlet, so that a uniform and stable yield stress condition is set up in the sheet across the width of the straight roller which simultaneously serves as a tool. In the narrow residual region at the neutral zone, there remain non-uniform, inherent stresses which, however, have no effect on subsequent warpage of the metal sheet.

The greatest overstretch is set up in the known roller levelers with a cold metal sheet thickness range of approximately 1.5 to 25 mm at the third (second) roller, viewed respectively from the inlet toward the outlet, and is selected to be between 6 and 3, depending on the unevenness, thickness and strength of the rolled material. Coiled and warm rolled material has less unevenness and requires a lower overstretch while with intensively cooled rolled material (pipe quality), a larger overstretch is necessary because of warping. Approximately 50% of the overstretch of the third roller is selected for the second roller. The following two overstretches, at the fourth or fifth roller, are meant to drop steeply and help achieve the internal equilibrium of moments, while observing a planar sheet condition, resulting in approximately 75% of the overstretch at the third roller of the same overstretch at the fifth roller. In further processing up to the next to last roller, slightly decreasing overstretch is to be chosen at the subsequent rollers, in order to achieve a stable leveling course, as well as a stable shape condition.

Metal sheets above the sheet thickness of nine are leveled with fewer rollers and less overstretch by the adjustment screw down concept of the invention because, by lowering or raising the leveling rollers, the roller pitch is quasi increased and the maximum roller leveling force is considerably diminished. While in the known roller levelers, the maximum leveling force at the second roller can hardly be obtained because of the lever ratios. As is also the case of the third roller, the lever ratios in the expanded leveling system can be changed by raising or lowering of the upper and lower leveling rollers which, for this purpose, are individually adjustable so that the largest force occurs at the second roller from the inlet. The largest leveling force is reduced by this measure to approximately 42% in the same leveler, whereby the sheet metal thickness to be leveled can be increased to approximately 1.55 of the nominal sheet thickness, depending upon the selection of the lowered or raised leveling rollers which are in engagement. Herein, the thicker metal sheets are leveled with fewer rollers and less overstretch, which is adequate with thicker metal sheets.

At the same time, a requirement sought in sheet metal leveling for a very long time for a leveler with replaceable cassettes, namely to decrease the time for replacement of the cassettes, is satisfied by the adjustment system of the invention. A portion of the leveling rollers need now merely to be raised or lowered in order to enable a better matching to the leveling program by means of different roller pitches.

Another refinement of the invention reduces the overstretch approximately as a ratio of the increase in thickness of the sheet. The increase of the cardan shaft moments can be compensated therewith. Instead of reducing the overstretch, the maximum leveled material yield point could alternatively be somewhat lowered because of the square function interrelationship.

BRIEF DESCRIPTION OF THE DRAWINGS

The invention will be better understood by the Detailed Description of the Preferred Embodiment, in connection with the drawings of which.

DETAILED DESCRIPTION OF THE PREFERRED EMBODIMENT

Figure 1:
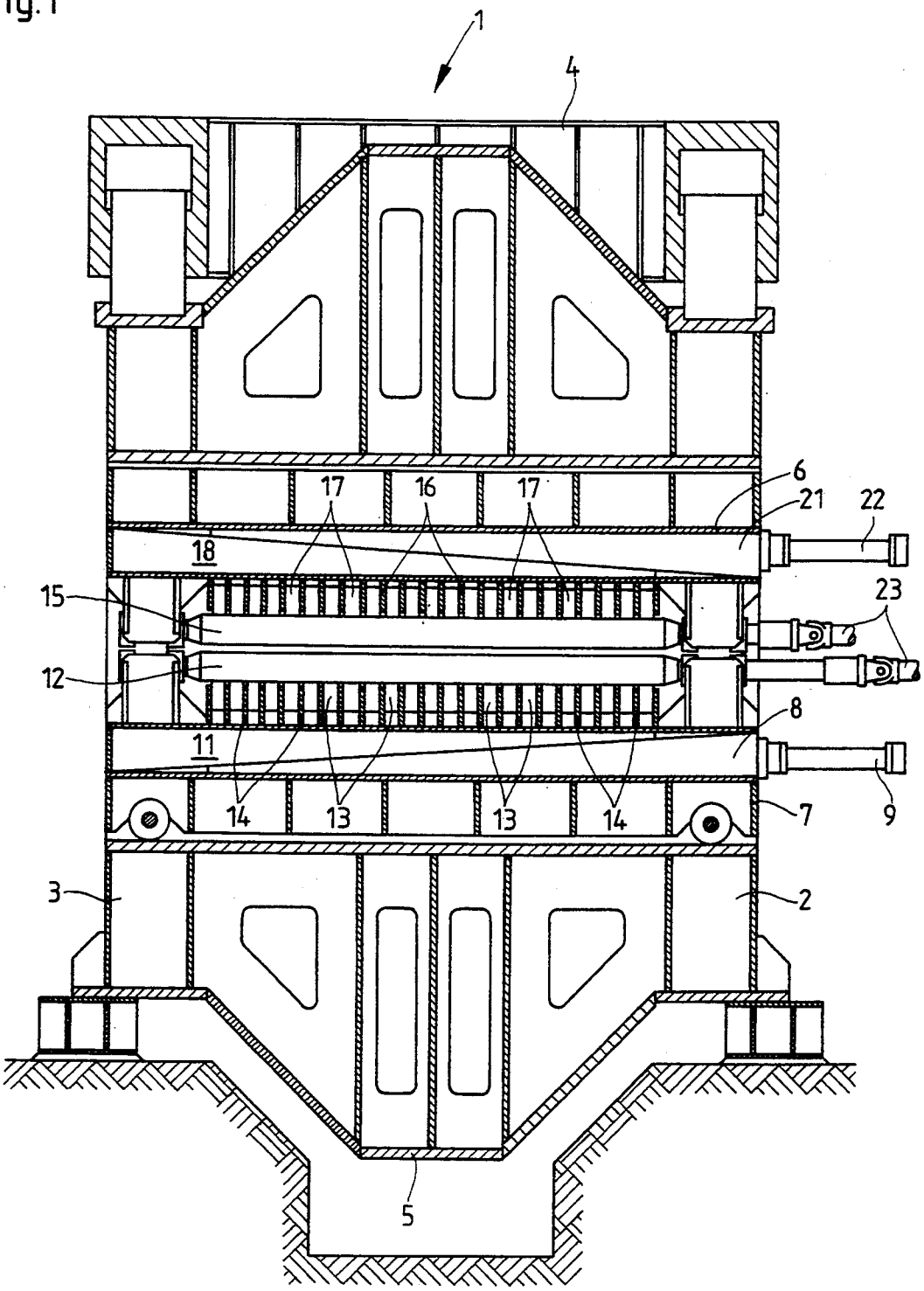
FIG. 1 is a cross-sectional view of a roller leveling machine.

Referring now to the drawings, FIG. 1 depicts an apparatus and method for levelling sheet metal in which the stand is formed by two posts or pillars 2, 3, anchored in the foundation and rigidly connected by a top and bottom traverse or cross beam 4, 5. An upper roller block 6 is retained at the upper cross beam 4 by cylinders which are not shown here; a lower roller block 7 is disposed to be displaceable on the lower cross beam 5. Adjustment wedges 8 are supported on the lower roller block 7 which are displaceable by a pressure agent-operated cylinder 9. A bearing support 11 abuts every adjustment wedge 8 for the lower leveling rollers 12 and backup roller 13 allocated to them. Abutment bearings 14 are disposed in between the backup rollers 13. Furthermore, several upper leveling rollers 15 are supported at their barrels by backup rollers 17 disposed in between the support bearings 16. The lower, as well as the upper leveling roller 12 or 15, are individually adjustable by adjustment devices (not shown). Thus, the upper leveling rollers 15 can be raised and the lower leveling rollers 12 can be lowered. The upper leveling rollers 15 and the backup roller 17 are supported by a bearing carrier 18. Each of the adjoining bearing carriers 18 is abutted at an adjustment wedge 21 whose other side rests at the upper roller block 6. The adjustment wedges 21 can be displaced by one each pressure agent operated cylinder 12. The upper and lower leveling rollers 15, 12 are individually driven and are connected by cardan shafts 23 to a drive unit (not shown).

Figure 2:
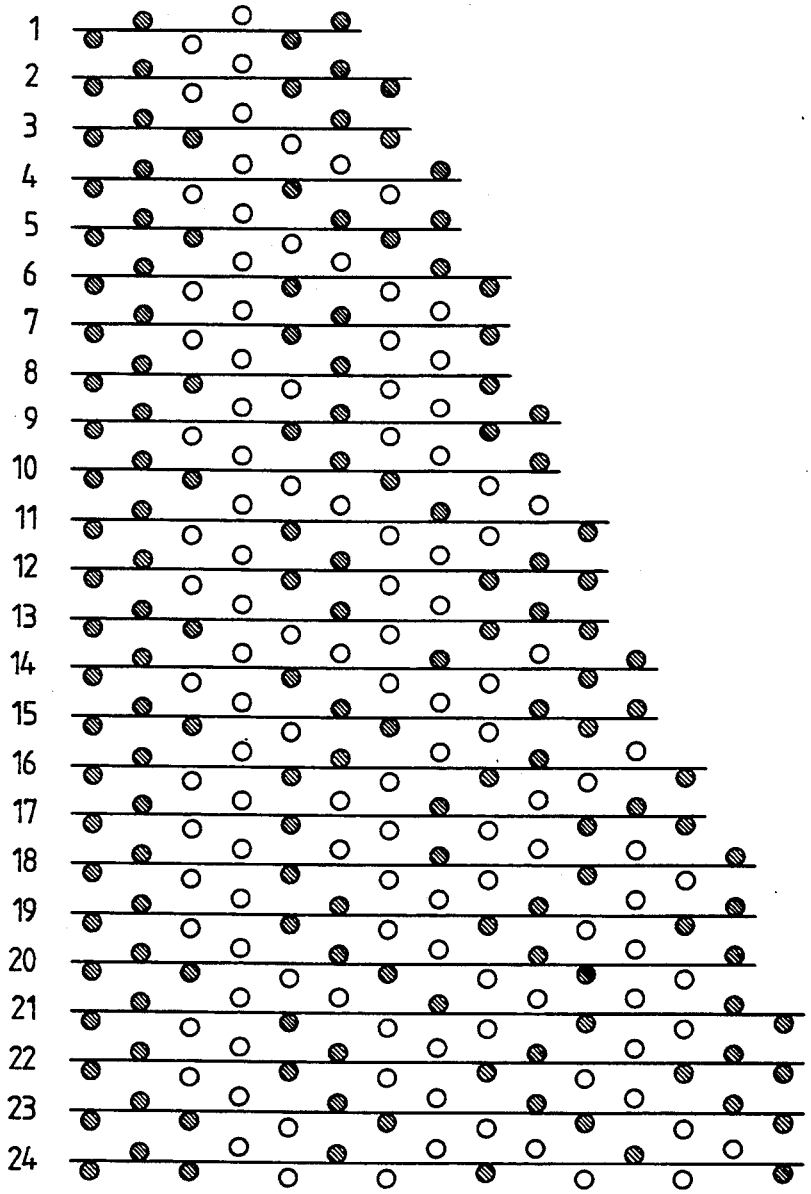
FIG. 2 schematically depicts different adjustment systems for roller leveling machines equipped with six to fifteen rollers.

As depicted in FIG. 2, for roller levelers with, for instance, six to fifteen rollers in a total of 24 variants, only several rollers of the leveling rollers existing overall are in use, while the other leveling rollers are either raised or lowered; the leveling rollers in respective use are shown as shaded circles. The sheet metal thickness, which can be leveled on one single roller leveling machine, can be increased by a factor of 1.55 by the adjustment variant shown. The adjustment variant, permitting the maximum of additional leveling range, is designated by XXX. As seen from FIG. 2, the nominal sheet thicknesses can be increased by a factor of 1.16 and 1.23 in seven, ten and thirteen roller leveling machines. With adjustment variants (not shown) in FIG. 2, which does not reflect completely the entirety of the possible variants, sheet metal thickness increases by a factor of 2.02 times can be achieved in a seventeen roller leveling machine. All the roller pitches need not be equal.

Figure 3:
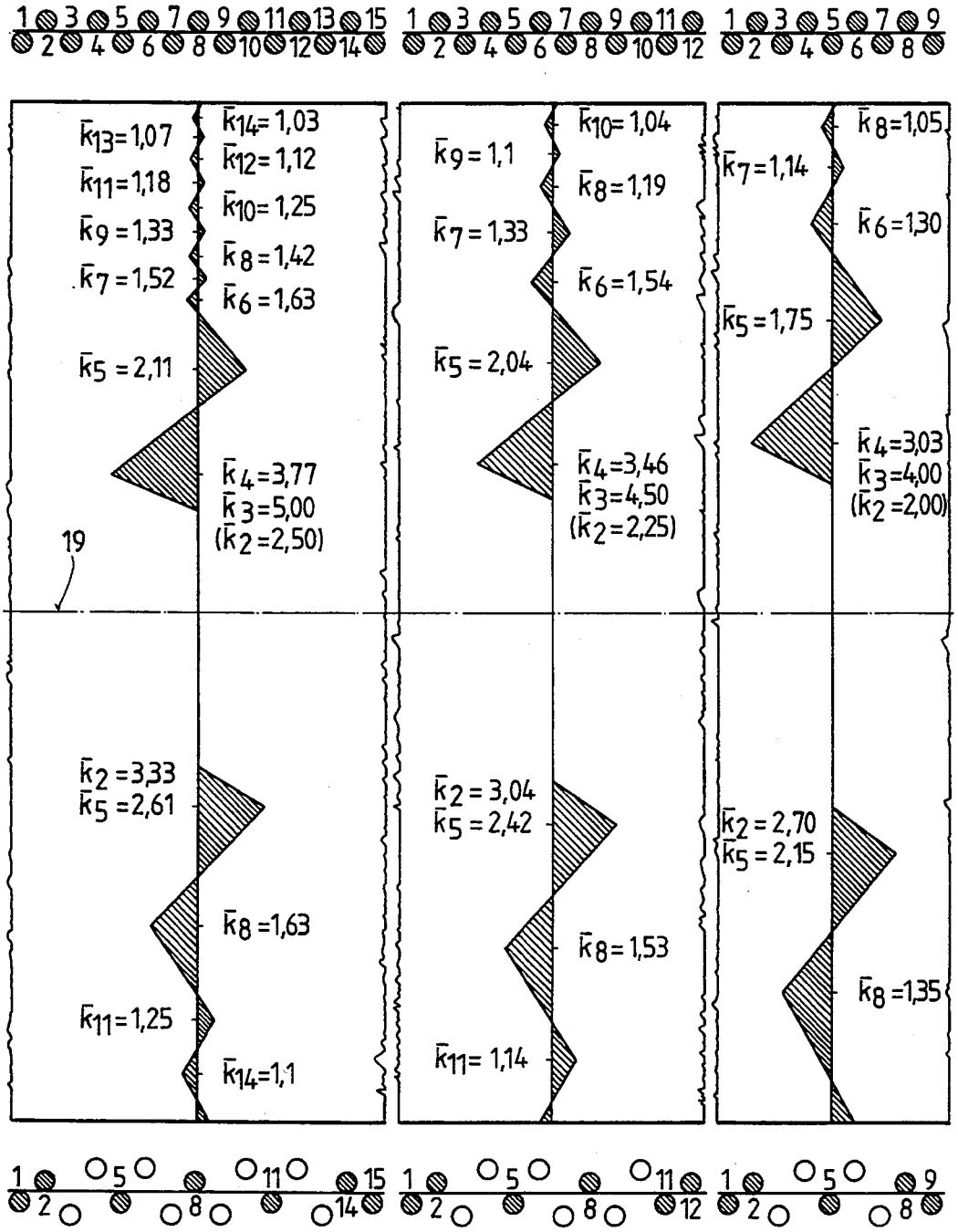
FIG. 3 schematically depicts residual stress conditions in fifteen, twelve, and nine roller leveler with overstretching data at the internal moment equilibrium above the center of the sheet metal corresponding to the state of the art, i.e., when using all leveling rollers and beneath the center of the sheet when using a portion of the leveling rollers, i.e., with raised or lowered upper or lower leveling rollers according to the invention.

FIG. 3 depicts the residual stress condition in fifteen, twelve and nine roller leveling machines with overstretch data at an internal equilibrium of moments. The adjustment system of the invention (see below the metal sheet center 19) is compared to conventional roller leveling machines where all rollers are engaged or screwed down against the metal sheet (see above the metal sheet center 19). With levelers equipped with nine to fifteen rollers, essentially the entire possible leveling range could be covered by the adjustment system expanded in the invention where the largest number of rollers can be used, wherein a roller leveler with nine rollers is preferred. Because of the determined overstretch distribution, there results, with conventional adjustments, a residual stress condition characterized by coarse teeth in direction toward the sheet center and a residual stress condition characterized by fine teeth toward the edges of the sheet. Because of the only low lever ratios or conditions, the residual stresses, having a coarse tooth profile toward the sheet center 19, have no deleterious effect upon the quality of the leveling. The residual stress course in roller levelers with lowered or raised leveling rollers, as can be seen below the sheet center 19, does not result in impermissibly disadvantageous stress courses, compared to roller levelers where all rollers are adjusted to work against the sheet metal. However, it can be stated that residual stresses with a coarse tooth profile are displaced to be much closer to the edges of the sheet as fewer leveling rollers are being used, which is no longer disadvantageous with thicker metal sheets.

The partial use of the leveling rollers (compare below the center of the metal sheet 19) and the overstretch sum selected there, as shown in FIG. 3, assure a good leveling quality in these roller levelers, in spite of the leveling range being expanded by a factor of 1.55. With roller levelers with lowered and raised leveling rollers, it is possible to level thicker sheets so that possibly a second leveler need not be used. If this is not necessary to level larger sheet thicknesses, the weight of the machine can be reduced instead of the above. The larger deformation work per individual drive with lowered or raised leveling rollers and sheet thicknesses above the nominal sheet thickness can be compensated according to the values shown in FIG. 3 by a recovery of the overstretch. If however the overstretch is to be maintained, then the drive of the lowered or raised leveling rollers can be coupled by the operators with the leveling rollers in operation. Alternatively, the nominal strengths could be reduced.

If the rollers are raised and lowered as follows, viewed from the inlet toward the outlet side: In a six roller machine, the third and fourth rollers; in a nine roller machine, the third and fourth as well as the sixth and seventh rollers; in an eleven roller and twelve roller leveler respectively, the third and fourth, sixth and seventh, as well as the ninth and tenth rollers; in a fourteen and fifteen roller leveler respectively, the third and fourth sixth and seventh, ninth and tenth, as well as the twelfth and thirteenth roller, etc.; then on one and the same leveler, metal sheets whose sheet thickness can amount to 1.55 times the nominal sheet thickness of the leveling range can be leveled, as described so that one obtains a considerably expanded leveling range without having to use two levelers for this purpose as previously required.

In a ten roller machine and a thirteen roller leveler, the leveling ranges can be expanded to a maximum of 1.23 times by lowering or raising the third and fourth as well as the seventh and eighth; or third and fourth, seventh and eighth as well as the eleventh and twelfth rollers.

While the preferred embodiment of the invention has been depicted in detail, various modifications and modifications may be made thereto without departing from the spirit and scope of the invention, as delineated in the following claims:

What is claimed is:

1. A method for leveling metal sheets comprising the steps of:

conveying the sheets through leveling gaps formed by a plurality for adjustable upper and lower leveling rollers and adjusted as a function of sheet cross-section and nominal sheet strengths;

initially deforming the sheet;

subsequently repeatedly bending the sheet in alternative directions with diminishing degrees of deformation; and expanding the leveling range of a leveling machine toward a thicker metal sheet by reducing a number of leveling rollers in engagement with the metal sheet by at least one of targeted lifting of individual upper leveling rollers and targeted lowering of individual lower leveling rollers so that a variable non-symmetrical pitch is provided between at least one of the individual upper leveling rollers and the individual lower leveling rollers, respectively.

2. The method of claim 1, further providing the reduction of overstretch as a function of the increase in metal sheet thickness.

3. The method of claim 1, further providing a six roller leveler, wherein the third or fourth roller, viewed from the inlet toward the outlet end, is lowered or raised.

4. The method of claim 1, wherein in an eight and nine roller leveler, respectively the third and fourth as well as the sixth and seventh rollers, viewed from the inlet toward the outlet end, is lowered or raised.

5. The method of claim 1, wherein in a ten roller leveler the third and fourth as well as the seventh and eighth rollers, viewed from the inlet end toward the outlet end, are lowered or raised.

6. The method of claim 1, wherein in an eleven and twelve roller leveler, respectively the third and fourth, sixth and seventh as well as the ninth and tenth rollers, viewed from the inlet toward the outlet end, are lowered or raised.

7. The method of claim 1, wherein in a thirteen roller leveler, the third and fourth, seventh and eighth as well as the eleventh and twelfth roller, viewed from the inlet toward the outlet end, are lowered or raised.

8. The method of claim 1, wherein in a fourteen and fifteen roller leveler, respectively the third and fourth, sixth and seventh, ninth and tenth as well as the twelfth and thirteenth rollers, viewed from the inlet toward the outlet end, are lowered or raised.

9. The method as in any one of claims 1 to 8, further comprising a roller leveler or roller leveling machine with individually adjustable upper and lower leveling rollers.

10. The method of claim 1, wherein roll pitches are set up enabling the highest force to be applied to the second levelling roll in engagement viewed from the entry side.

* * * * *